US007014881B2

(12) United States Patent
Liu et al.

(10) Patent No.: US 7,014,881 B2
(45) Date of Patent: Mar. 21, 2006

(54) SYNTHESIS OF MULTI-ELEMENT OXIDES USEFUL FOR INERT ANODE APPLICATIONS

(75) Inventors: Xinghua Liu, Murrysville, PA (US); Siba P. Ray, Murrysville, PA (US); Alfred F. LaCamera, Trafford, PA (US); Douglas A. Weirauch, Murrysville, PA (US); Mark L. Weaver, Greenwell Springs, LA (US); Robert A. DiMilia, Greenburg, PA (US); Kirk J. Malmquist, East Wenatchee, WA (US); Frankie E. Phelps, Apollo, PA (US); Joseph M. Dynys, New Kensington, PA (US)

(73) Assignee: Alcoa Inc., Pittsburgh, PA (US)

( * ) Notice: Subject to any disclaimer, the term of this patent is extended or adjusted under 35 U.S.C. 154(b) by 604 days.

(21) Appl. No.: 10/294,186

(22) Filed: Nov. 13, 2002

(65) Prior Publication Data

US 2003/0121775 A1 Jul. 3, 2003

Related U.S. Application Data

(63) Continuation-in-part of application No. 09/542,318, filed on Apr. 4, 2000, now Pat. No. 6,423,195, and a continuation-in-part of application No. 09/542,320, filed on Apr. 4, 2000, now Pat. No. 6,372,119, which is a continuation-in-part of application No. 09/431,756, filed on Nov. 1, 1999, now Pat. No. 6,217,739.

(51) Int. Cl.
*B05D 5/12* (2006.01)

(52) U.S. Cl. ..... 427/78; 427/77; 427/126.3; 427/126.6; 427/419.2; 427/419.7; 427/421.1; 427/427; 427/427.1; 264/6; 264/104; 264/681; 75/232; 75/233; 423/138; 423/593.1; 423/594.1; 423/594.3; 423/594.5; 423/594.15

(58) Field of Classification Search ..... 427/419.2, 427/419.7, 77, 78, 126.6, 421.1, 427, 427.1; 75/232, 233; 264/6, 104, 681; 423/138, 423/593.1, 594.1, 594.3, 594.5, 594.15
See application file for complete search history.

(56) References Cited

U.S. PATENT DOCUMENTS

| | | | | |
|---|---|---|---|---|
| 4,097,392 | A | 6/1978 | Goldman et al. | 252/62.62 |
| 4,097,412 | A | 6/1978 | Muller | 252/465 |
| 4,100,109 | A | 7/1978 | Muller | 252/465 |
| 4,400,431 | A | 8/1983 | Henslee et al. | 428/402 |
| 4,678,505 | A | 7/1987 | Bushey | 75/0.5 |
| 4,894,185 | A | 1/1990 | Djega-Mariadassou et al. | 252/519 |
| 5,051,394 | A | 9/1991 | Haruta et al. | 502/324 |
| 5,110,782 | A | 5/1992 | Hirono et al. | 502/303 |
| 5,168,095 | A | 12/1992 | Munakata et al. | 505/1 |

(Continued)

*Primary Examiner*—Bruce F. Bell
(74) *Attorney, Agent, or Firm*—Daniel P. Cillo; Eckert Seamans Cherin & Mellott, LLC

(57) ABSTRACT

An inert anode 50, for use in an electrolytic cell 12 for producing metals such as aluminum, is made by providing chemical source materials 100 such as at least two of metal salts, metal particles, or metal oxides and dissolving them to form a solution or a slurry 110, followed by adding a base 120 and adjusting the pH so that a gel 130 is formed which is dried and calcined 150, 160, 190 to provide a blend of metal oxide powder 200 which can be pressed and sintered 220 to form an inert anode 50.

25 Claims, 6 Drawing Sheets

U.S. PATENT DOCUMENTS

| | | | | |
|---|---|---|---|---|
| 5,290,759 | A | 3/1994 | Richardson et al. | 505/1 |
| 5,420,086 | A | 5/1995 | Brandau et al. | 501/103 |
| 5,449,660 | A | 9/1995 | Munakata et al. | 505/441 |
| 5,788,950 | A | 8/1998 | Imamura et al. | 423/593 |
| 5,794,112 | A | 8/1998 | Ray et al. | 419/21 |
| 5,865,980 | A | 2/1999 | Ray et al. | 205/367 |
| 6,015,637 | A | 1/2000 | Mitate et al. | 429/231.1 |
| 6,126,799 | A * | 10/2000 | Ray et al. | 204/291 |
| 6,217,739 | B1 | 4/2001 | Ray et al. | 205/385 |
| 6,332,969 | B1 * | 12/2001 | Ray et al. | 205/362 |
| 6,416,649 | B1 * | 7/2002 | Ray et al. | 205/387 |
| 6,758,991 | B1 * | 7/2004 | DiMilia et al. | 252/519.1 |
| 6,821,312 | B1 * | 11/2004 | Ray et al. | 75/233 |

* cited by examiner

SYNTHESIS OF MULTI-ELEMENT OXIDES USEFUL FOR INERT ANODE APPLICATIONS

CROSS REFERENCE TO RELATED APPLICATIONS

This application is a continuation-in-part of U.S. Ser. No. 09/542,318 filed Apr. 4, 2000, now U.S. Pat. No. 6,423,195 granted on Jul. 23, 2002 and a continuation-in-part of U.S. Ser. No. 09/542,320 filed Apr. 4, 2000, now U.S. Pat. No. 6,372,119 granted on Apr. 16, 2002, each of which is a continuation-in-part of U.S. Ser. No. 09/431,756 filed on Nov. 1, 1999, now U.S. Pat. No. 6,217,739 B1, which issued on Apr. 17, 2001.

FIELD OF THE INVENTION

The present invention relates to electrolysis in a cell having an inert anode such as a ceramic of cermet anode comprising multi-element oxides. More particularly, the invention relates to synthesizing extremely fine powders useful in such inert anodes where the powders are made by gel-co-precipitation methods.

BACKGROUND OF THE INVENTION

The energy and cost efficiency of aluminum smelting can be significantly reduced with the use of inert, non-consumable and dimensionally stable anodes. Replacement of traditional carbon anodes with inert anodes allows a highly productive cell design to be utilized, thereby reducing capital costs. Significant environmental benefits are also possible because inert anodes produce essentially no $CO_2$ or $CF_4$ emissions. Some examples of inert anode compositions are provided, for example, in U.S. Pat. Nos. 5,794,112 and 5,865,980, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, of about 900° C. to 1,000° C., so that the voltage drop at the anode is low.

Oxides that are particularly well suited for processing into advanced inert, non-consumable and dimensionally stable anodes, such as, for example, $M_xFe_{3-x}O_{4\pm\delta}$, where x from 0 to 3, M represents one or more elements selected from at least one of the group of Ni, Cu, Co, Zn, Cr, Mn, Al, Sc, Y, La, Ti, Zr, Hf, V, Nb, Ta, Pd, Ag, Ca, Sr, or Sn, respectively, and δ is a variable dependent on process conditions. The oxides are used alone or with a metal phase including copper and/or at least one noble metal, and are usually made by conventional solid-state reaction techniques, which require repeat ball milling of calcined oxide powders. This conventional method often produces chemically inhomogeneous oxide powders with larger particle sizes and wide size distribution. The chemically inhomogeneous oxides can cause second phases present on fired parts that affect their performance. Large particle size requires time-consuming grinding/milling. For example, U.S. Pat. Nos. 5,794,112 and 5,865,980 (both Ray et al.) taught ball milling a mixture of NiO and $Fe_2O_3$ that had already been mixed, ground and calcined for 12 hours at 1250° C. Particles of about 10 micrometers average particle size were the end product after about 40 hr. ball milling. FIG. 1 shows a representation of 40 hr. ball milled particles using conventional methods. Besides composition inhomogenity, the wide distribution of particle size may lead to high porosity and less uniform microstructure due to non-uniform grain growth during sintering. These particles were blended with water and polymeric binder and spray dried, V-blended and pressed into an anode shape for sintering. U.S. Pat. No. 6,217,739 B1 (Ray et al.) taught $Fe_2O_3$, NiO and ZnO inert anode starting materials where a metal phase could comprise copper and/or silver and the like. The inert anodes could be formed by standard powder forming, sol-gel processing, slip casting, coating or hot pressing, preferably powder techniques, which were emphasized in the patent.

Djega-Marinadassou et., in U.S. Pat. No. 4,894,185 taught making zinc oxide based powder for varistors by providing a mixture of zinc nitrate or zinc chloride with a minor amount of, for example, cobalt nitrate to provide a mixed solution in water and then providing a bismuth nitrate or lead nitrate solution. Both solutions were added to a given volume of ammonia buffer solution, pre-saturated by cations of the elements to be precipitated—zinc and cobalt, kept at a defined pH, leading to precipitation of the hydroxides to provide a co-precipitate. The co-precipitate is then filtered, dried at room temperature, and finally calcined at 700° C. to provide a homogeneous oxide material. U.S. Pat. No. 5,290,759 (Richardson et al.) taught Y $Ba_2Cu_3O_{6+x}$ metal oxide superconductors by co-precipitation of respective nitrates using alkali hydroxide as a precipitating agent, followed by filtration, washing in the presence of $CO_2$, drying, firing and cooling.

An earlier process by Goldman et al., in U.S. Pat. No. 4,097,392 taught manufacturing ferrimagnetic material, such as manganese-zinc ferrites, for magnetic ceramics to provide a more homogeneous product. There, pure metals were used as the starting materials in making the aqueous metal ion solution rather than salts of the metals, where other metals such as zinc, manganese, nickel and magnesium can be added to the iron metal ions. The aqueous metal ion solution is then reacted with an ammonium, sodium or potassium carbonate solution to concurrently co-precipitate ferrous hydroxide and one of the other metals without conversion to ferric ions in a manner to provide a selected ratio between carbonate and hydroxide groups. The co-precipitated material is then separated from the liquid phase and dried. U.S. Pat. No. 5,788,950 (Imamura et al.) is another patent in this area, where ceramic oxide provides for filters, capacitors or oxygen sensors are synthesized. There, a liquid absorbent resin is combined with solutions containing organo-metallic compounds and solutions containing metallic salt compounds. The resin then swells and gels. A precursor material is then prepared by changing the pH and/or temperature of the swollen gel. After pyrolyzing and calcining, a mixed metal oxide powder is formed, providing more homogeneous, smaller sized powders than either co-precipitation or repeated ball milling and providing a much less expensive process than sol-gel routes which usually involve use of very expensive precursors.

While all of these approaches have various advantages, in methods by Djega-Mariadassou et al. and Goldman et al., there are three drawbacks: 1) because different metals tend to precipitate out at different pH, it causes non-homogeneous precipitates which will give non-homogeneous final products; 2) the precipitate needs to be separated/filtered from solution. There are always residual metal cations left in the solution that usually lead to final composition shift; 3) if alkali hydroxides/carbonates are used, the residual alkali cation will contaminate the final products. Method by Imamura et al. used resin to form a gel then pyrolyze and calcine the gel. The large amount of resin not only increases the cost but also causes $CO/CO_2$ during pyrolyzing and calcining. What is needed is a simpler approach than that of Inamura et al. while still solving the problems of co-precipitation and sol-gel processing cited by Imamura et al.

The present invention has been developed in view of the foregoing and to address other deficiencies of the prior art.

SUMMARY OF THE INVENTION

The present invention provides an inert anode including at least one ceramic phase material which comprises multi-component oxides. The inert anode may also comprise at least one metal phase including copper and/or at least one noble metal. An aspect of the invention is to provide an inert anode composition suitable for use in a molten salt bath.

It is one of the main objects of this invention to provide a wet process for producing multi-element metal oxide particulates in the nanometer crystallite size scale. It is another object of this invention to provide an inexpensive gel-co-precipitation process to produce the above particulates. The product of these processes can then be spray-dried and pressed, then sintered to form inert anodes for electrolytic cells.

These and other objects of the invention are accomplished by providing a method of producing an inert anode for an electrolytic metal cell where the anode is made from multi-element metal oxide powders containing at least three elements, comprising the steps: (a) providing a precursor aqueous solution comprising metal ions; (b) adjusting the pH of the precursor aqueous solution with a basic solution to the pH range of from 3 to 14 such that a gel is formed; (c) calcining the gel to provide metal oxide powder; (d) adding the metal oxide powder and a material comprising a binder to a solvent to form a slurry; (e) spray drying the slurry to form granules; and (f) pressing the granules. In step (d) dispersant can also be added and, if a cermet material is desired, also a metal powder, to create a ceramic-metal material. The invention is also directed to a method for producing an inert anode where the anode is made from fine, homogeneous multi-element metal oxide powders containing at least three elements, comprising the steps: a) providing a precursor aqueous solution by dissolving at least one material selected from the group consisting of metal salts, metal particles, metal oxides, and mixtures thereof, where the precursor aqueous solution contains metal ions; b) adjusting the pH of the precursor aqueous solution with a base solution in the pH range of from 3 to 14 such that a gel is formed; c) calcining the gel to provide metal oxide powder; d) adding the metal oxide powder and a binder to a solvent to form a slurry; e) spray drying the slurry to form granules; f) pressing the granules to form a green body; and g) firing the green body to form an inert anode. These inert anodes can be made of all ceramic oxides or also include a metal phase, where additional metal powder is added in step (d), to provide cermet inert anodes. A dispersant is also a helpful addition in Step (d) to help provide a homogenous slurry.

In another aspect of the invention, the inert anode is made by: a) providing a homogeneous precursor aqueous solution by dissolving materials selected from the group consisting of metal salts, metal particles, metal oxides, and mixtures thereof, where the precursor aqueous solution contains at least two metal ions selected from the group consisting of Ni, Fe, Cu, Co, Zn, Cr, Mn, Al, Sc, Y, La, Ti, Zr, Hf, V, Nb, Ta, Pd, Ag, Ca, Sr, or Sn and mixtures thereof; b) adjusting the pH of the precursor aqueous solution with a base solution selected from at least one of ammonium hydroxide solution and organic base hydroxide solution, to the pH range of from 3 to 14 such that a gel is formed; c) optionally drying the gel; d) calcining the gel at from 400° C. to 1200° C. to provide metal oxide powder; e) optionally grinding (comminuting) the blend of metal oxide powder; f) adding the metal oxide powder and a material selected from at least one of a dispersant and binder to a solvent to provide a slurry; g) spray drying the slurry to form granules; h) pressing the granules to form a green body and firing the green body to form an inert anode. The powder formed in step d) has a particle size of from about 5 nanometers (nm) to 1000 nanometers, preferably 5 to 500 nanometers approximate diameter.

The term "homogeneous solution" as used herein means that all the constituents in the solvent are mixing uniformly at a molecular level. If the solvent is water, the solution is called an aqueous solution. The term "precursor" as used herein means input chemicals that lead to the final product. Metal powders include particulates or pellet metals with a volume less than 1 cubic cm. Binders are organic or inorganic additives in ceramic process to permit handling, machining, or other operations prior to being densified by firing. Organic binders include: polyvinyl alcohol (PVA); waxes; celluloses; dextrines; thermoplastic resins; thermosettling resins; alginates; rubbers; gums; starches; casein; gelatins; albumins; proteins; bitumen materials; acrylics; and vinyls; colloidal alumina, aluminates, aluminum silicates, and the like. The term "dispersant" means a surface active agent which enhances the dispersion of particles in a slurry by charge repulsion or steric hindrance in the slurry. Some examples of suitable dispersants includes amines, glyceryl trioleate, glyceryl monooleate, corn oil, menhaden fish oil, and surfactants. These are used, preferably, with the binder and metal powder. Suitable solvents include water, alcohol and mixtures thereof.

The most preferred method comprises the steps: a) providing a precursor by dissolving at least one material selected from the group consisting of metal salts, metal particles, metal oxides and mixtures thereof where the precursor aqueous solution contains at least two metal ions; b) adjusting the pH of the precursor aqueous solution with a base solution selected from at least one of ammonium hydroxide solution and organic base hydroxide solution, to the pH range of from 3 to 12 such that a co-precipitated gel is formed; c) spraying the co-precipitated gel into an oxidizing atmosphere at a temperature of from 400° C. to 1,200° C. to provide a blend of metal oxide powders having a homogeneous dispersion of the metal ions in the powder particles, said powders having a particle size of from about 5 nm to about 1000 nm; d) adding the powder and a material selected from at least one of a dispersant and binder to a solvent to provide a slurry; e) spray-drying the slurry to form granules, and f) pressing the granules to form a green body; and g) firing the green body to produce an inert anode.

Additional aspects and advantages of the invention will occur to persons skilled in the art from the following detailed description.

BRIEF DESCRIPTION OF THE DRAWINGS

For a better understanding of the invention, reference may be made to the following non-limiting figures, in which.

DETAILED DESCRIPTION OF PREFERRED EMBODIMENTS

Figure 2:
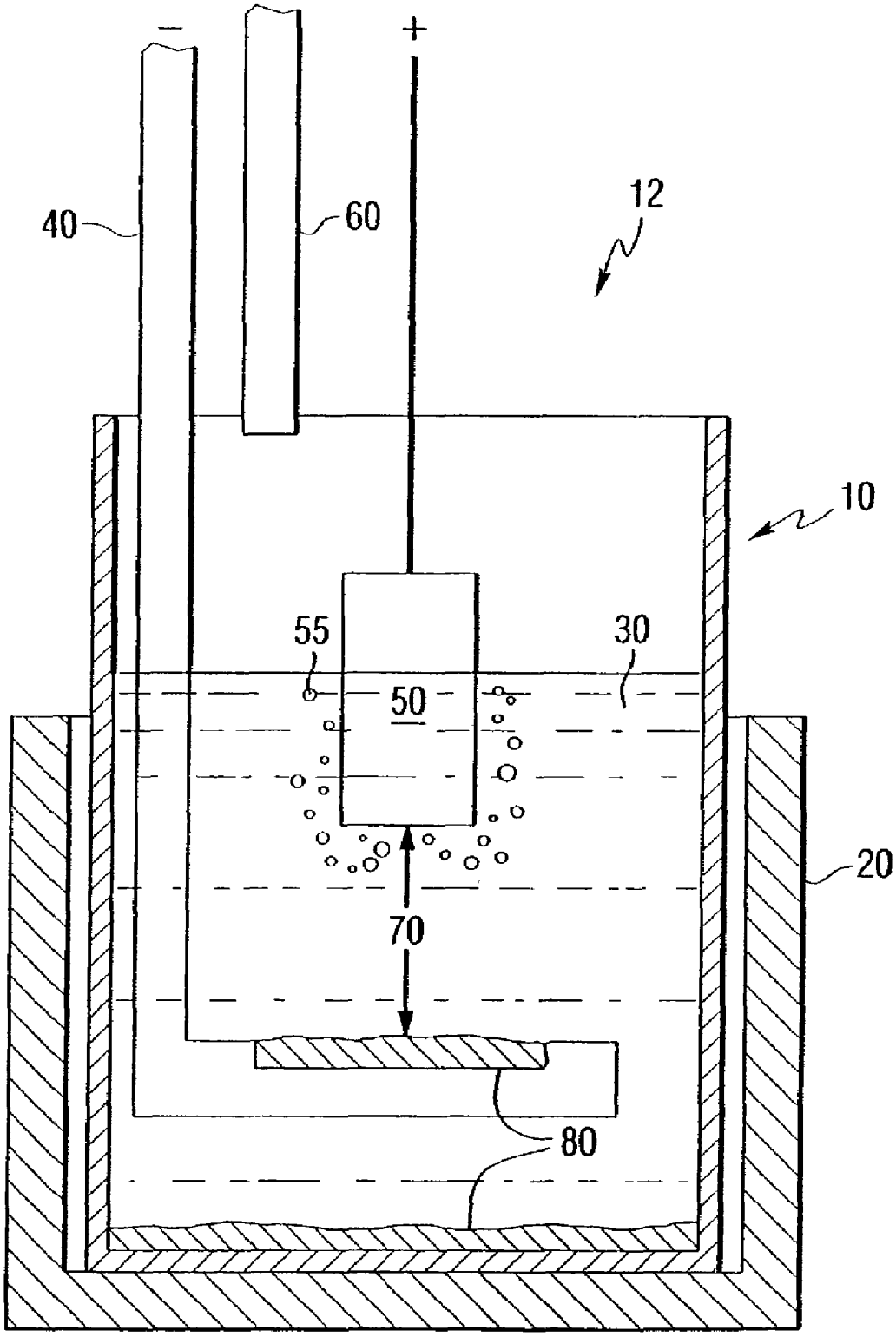
FIG. 2 is a partly schematic sectional view of a general type electrolytic cell for the production of aluminum, including an inert anode in accordance with an embodiment of the present invention.

FIG. 2 schematically illustrates one type of an electrolytic cell 12 for the production of, for example aluminum, which includes an inert anode in accordance with an embodiment of the present invention. The cell includes an inner crucible 10 inside a protection crucible 20. A cryolitic bath 30 is contained in the inner crucible 10, and a cathode 40 is provided in the bath 30. An inert anode 50 is positioned in the bath 30. An alumina feed tube 60 extends partially into the inner crucible 10 above the bath 30. The cathode 40 and inert anode 50 are separated by a distance 70 known as the anode-cathode distance (ACD). Aluminum 80 produced during a run is deposited on the cathode 40 and on the bottom of the crucible 10. Reaction gases are shown as bubbles 55. In addition to the production of aluminum, the inert anodes of the invention may also be useful in producing metals such as lead, magnesium, zinc, zirconium, titanium, lithium, sodium, calcium, silicon and the like, by electrolytic reduction of an oxide or other salt of the metal.

As used herein, the term "inert anode" means a substantially non-consumable anode which possesses satisfactory corrosion resistance and stability during the aluminum production process. These can be ceramic or cermet. The term "commercial purity aluminum" as used herein means aluminum which meets commercial purity standards upon production by an electrolytic reduction process. The commercial purity aluminum preferably comprises a maximum of 0.2 wt. % Fe, 0.034 wt. % Ni, and 0.034 wt. % for each of other elements. In a more preferred embodiment, the commercial purity aluminum comprises a maximum of 0.15 wt. % Fe, 0.03 wt. % Ni, and 0.03 wt. % for each of other elements. In a particularly preferred embodiment, the commercial purity aluminum comprises a maximum of 0.13 wt. % Fe, 0.03 wt. % Ni, and 0.03 wt. % for each of other elements. The commercial purity aluminum also preferably meets the following weight percentage standards for other types of impurities: 0.2 maximum Si; and 0.034 maximum for each of other impurities. The Si impurity level is more preferably kept below 0.15 wt. % or 0.10 wt. %, and other impurity levels are more preferably kept below 0.03 wt. %. It is noted that for every numerical range or limit set forth herein, all numbers with the range or limit including every fraction or decimal between its stated minimum and/or maximum are considered to be designated and disclosed by this description.

Cermet inert anodes of the present invention have at least one ceramic phase, and in a particular embodiment also have at least one metal phase. For cermets, the ceramic phase typically comprises at least 50 wt. % of the cermet, preferably from about 70 to about 90 wt. % of the cermet. At least a portion of the anode may comprise up to 100% of the ceramic phase. In one embodiment, the anode may comprise a cermet or metal core coated with the ceramic phase. In this embodiment, the outer ceramic layer preferably has a thickness of from 0.1 to 50 mm, more preferably from 0.2 to 10 mm.

The ceramic phase or ceramic inert anode can comprise oxides of nickel, iron and zinc or cobalt and is of the formula $M_xFe_{3-x}O_{4\pm\delta}$, where x from 0 to 3, M or more of the elements selected from Ni, Cu, Co, Zn, Cr, Mn, Al, Sc, Y, La, Ti, Zr, Hf, V, Nb, Ta, Pd, Ag, Ca, Sr, or Sn respectively, and δ is a variable dependent on process conditions. In the foregoing formula, the oxygen stoichiometry is not necessarily equal to 4, but may change slightly up or down depending upon firing conditions by a magnitude of δ. The value of δ may range from 0 to 0.9, preferably from 0 to 0.6.

Table 1 lists some ternary Ni—Fe—Zn—O materials that my be suitable for use as the ceramic phase of the present inert anodes, as well as some comparison materials. In addition to the phases listed in Table 1, minor or trace amounts of other phases may be present.

TABLE 1

Ni—Fe—Zn—O Compositions

| Sample I.D. | Nominal Composition Molar ratio Fe/Ni/Zn | Measured Elemental Weight Percent Fe, Ni, Zn | Structural Types (identified by XRD) |
|---|---|---|---|
| E4 | 2.0/0.95/0.05 | 43, 22, 1.4 | $NiFe_2O_4$ |
| E3 | 2.0/0.9/0.1 | 43, 20, 2.7 | $NiFe_2O_4$ |
| E2 | 2.0/0.75/0.25 | 04, 15, 5.9 | $NiFe_2O_4$ |
| E1 | 1.9/0.75/0.25 | 45, 18, 7.8 | $NiFe_2O_4$ |
| E | 2.0/0.5/0.5 | 45, 12, 13 | $(ZnNi)Fe_2O_4$, ZnO |
| F | 2.0/0.1/1.0 | 43, 0.03, 24 | $ZnFe_2O_4$, ZnO |
| H | 1.5/1.0/0.5 | 33, 23, 13 | $(ZnNi)Fe_2O_4$, NiO |
| J | 1.0/1.5/0.5 | 26, 39, 10 | $NiFe_2O_4$, NiO |
| L | 1.0/1.0/1.0 | 22, 23, 27 | $(ZnNi)Fe_2O_4$, NiO, ZnO |
| ZD6 | 1.9/1.05/0.05 | 40, 24, 1.3 | $NiFe_2O_4$ |
| ZD5 | 1.8/1.1/0.1 | 29, 18, 2.3 | $NiFe_2O_4$ |
| ZD3 | 1.88/0.94/0.12 | 43, 23, 3.2 | $NiFe_2O_4$ |
| ZD1 | 1.5/0.75/0.5 | 40, 20, 11 | $(ZnNi)Fe_2O_4$ |
| DH | 1.8/0.18/0.96 | 42, 23, 4.9 | $NiFe_2O_4$, NiO |
| DI | 1.5/1.17/0.08 | 38, 30, 2.4 | $NiFe_2O_4$, NiO |
| DJ | 1.5/1.1/0.17 | 36, 29, 4.8 | $NiFe_2O_4$, NiO |
| BC2 | 0.0/0.67/0.33 | 0.11, 52, 25 | NiO |

Tables 2 and 3 list some Ni—Fe—Co—O and Ni—Zn—Al—Fe—O materials that may be suitable as the ceramic phase of the present inert anodes, as well as Co—Fe—O and Ni—Fe—O comparison materials. In addition to the phases listed in Table 2, minor or trace amounts of other phases may be present.

TABLE 2

Ni—Fe—Co—O Compositions

| Sample I.D. | Nominal Composition | Measured Elemental Weight Percent Fe, Ni, Co | Structural Types (identified by XRD) |
|---|---|---|---|
| CF | 2.0/0.0/1.0 | 44, 0.17, 24 | $CoFe_2O_4$ |
| NCF1 | 2.0/0.5/0.5 | 44, 12, 11 | $NiFe_2O_4$ |
| NCF2 | 2.0/0.7/0.3 | 45, 16, 7.6 | $NiFe_2O_4$ |
| NCF3 | 1.95/0.7/0.3 | 42, 18, 6.9 | $NiFe_2O_4$ |
| NCF4 | 1.95/0.85/0.15 | 44, 20, 3.4 | $NiFe_2O_4$ |
| NCF5 | 1.9/0.8/0.3 | 45, 20, 7.0 | $NiFe_2O_4$, NiO |

TABLE 3

Ni—Zn—Al—Fe—O Compositions

| Sample I.D. | Nominal Composition Molar Ratio Fe/Ni/Al/Zn |
|---|---|
| ZnNiAlFeO-1 | 1.5/0.5/0.5/0.5 |
| ZnNiAlFeO-2 | 1.25/0.9/0.75/0.1 |
| ZnNiAlFeO-3 | 1.8/0.9/0.75/0.1 |
| ZnNiAlFeO-4 | 1.5/0.75/0.5/0.25 |
| ZnNiAlFeO-5 | 1.0/0.5/1.0/0.5 |
| ZnNiAlFeO-6 | 0.0/0.0/2.0/1.0 |

The inert anodes may be produced by techniques such as powder forming/sintering, slip casting, coating, hot pressing, or hot isostatic pressing (HIP) from oxide powders made by conventional solid state ceramic process (blending, calcining, ball-milling, etc.) or, preferably, as in this invention, by a gel co-precipitation technique.

The oxide compositions listed in the preceding tables and many other useful inert anode materials may be prepared and tested as follows. Oxide powders are synthesized by gel-co-precipitation approach. The first step is to make metal salt solutions, which include one or a mixture of chlorides, acetates, nitrates, tartarates, citrates and/or sulfates of Ni, Fe, Cu, Co, Zn, Cr, Mn, Al, Sc, Y, La, Ti, Zr, Hf, V, Nb, Ta, Pd, Ag, Ca, Sr, or Sn, and the like. Chlorides, acetates and nitrates are preferred precursors. The starting chemicals can be metal particles, metal salts, metal oxides or mixtures thereof Metal particles and oxide powders have to be dissolved into acid to form concentrated salt (ion) solutions. By "concentrated" is meant: total salt concentration is more than 20% by weight. After a homogeneous aqueous solution is prepared, that is a completely dissolved solution uniform throughout, the solution pH is then adjusted to from 3 to 14 by adding ammonium hydroxide or an organic base hydroxide while stirring.

Figure 3:
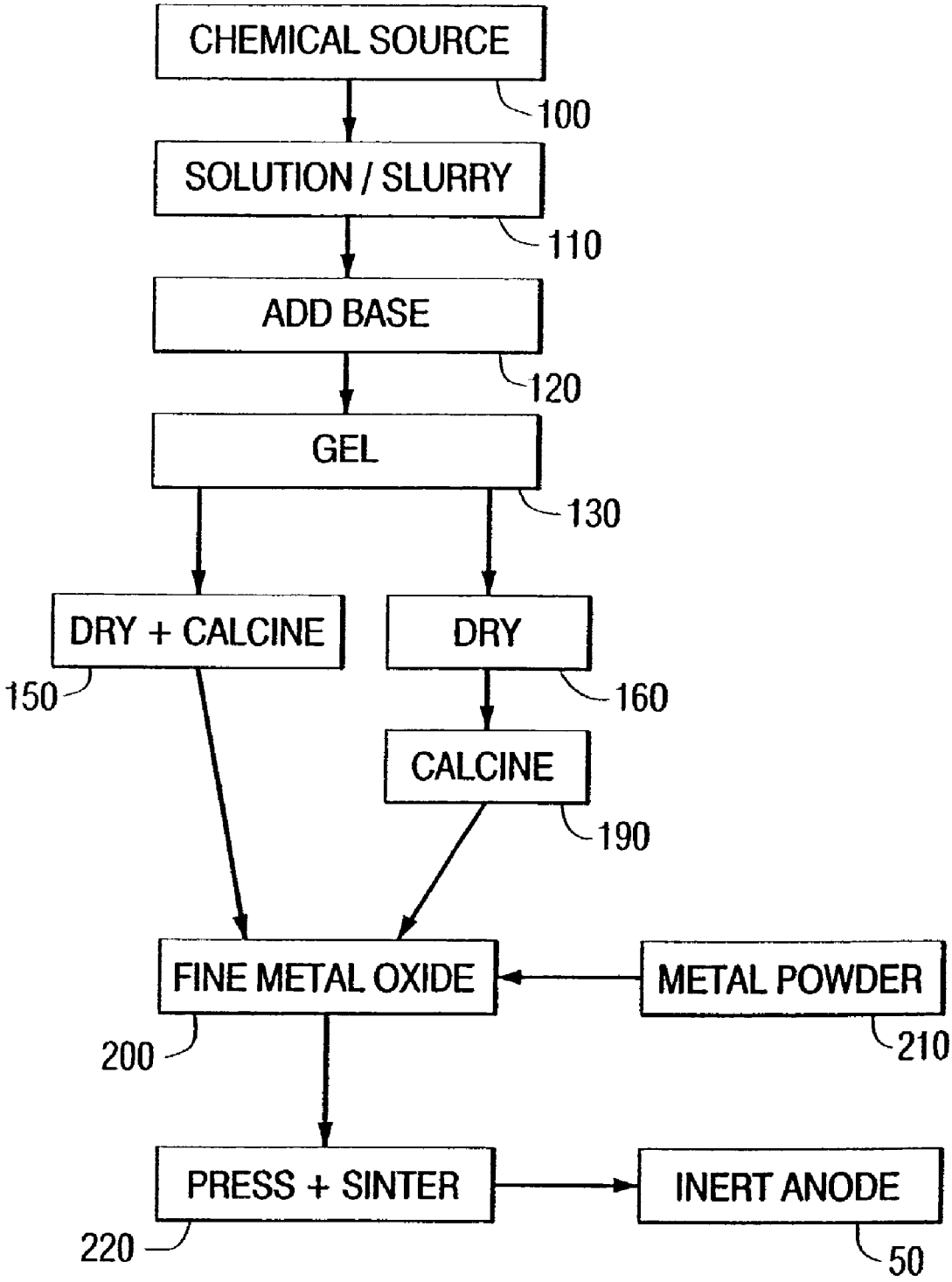
FIG. 3, which best shows the invention, is a block diagram showing the general method of this invention.

Referring now to FIG. 3 of the drawings, the general inventive process is set out in block diagram form. Generally, in step 100, the chemical sources, such as the metals, metal oxides, metal salts or their mixtures are provided. In step 110 an aqueous solution or slurry is formed by dissolving the metals, metal oxides or their mixture into acid, or by dissolving metal salts into deionized water.

Figure 1:
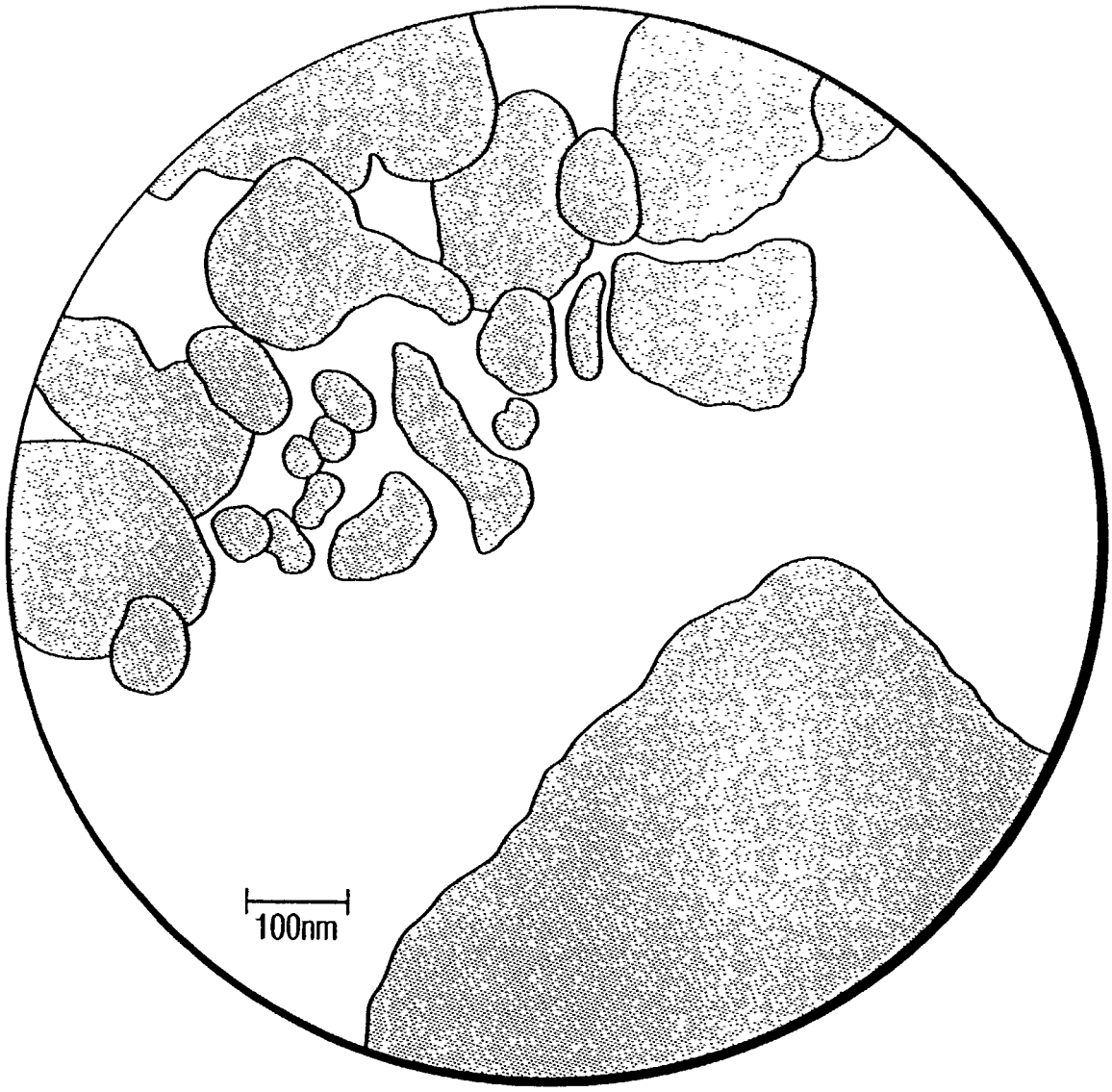
FIG. 1 is an idealized magnified drawing showing the relative diameters in nm of 40 hr ball milled oxide particles produced by a conventional solid state reaction method.
Figure 4:
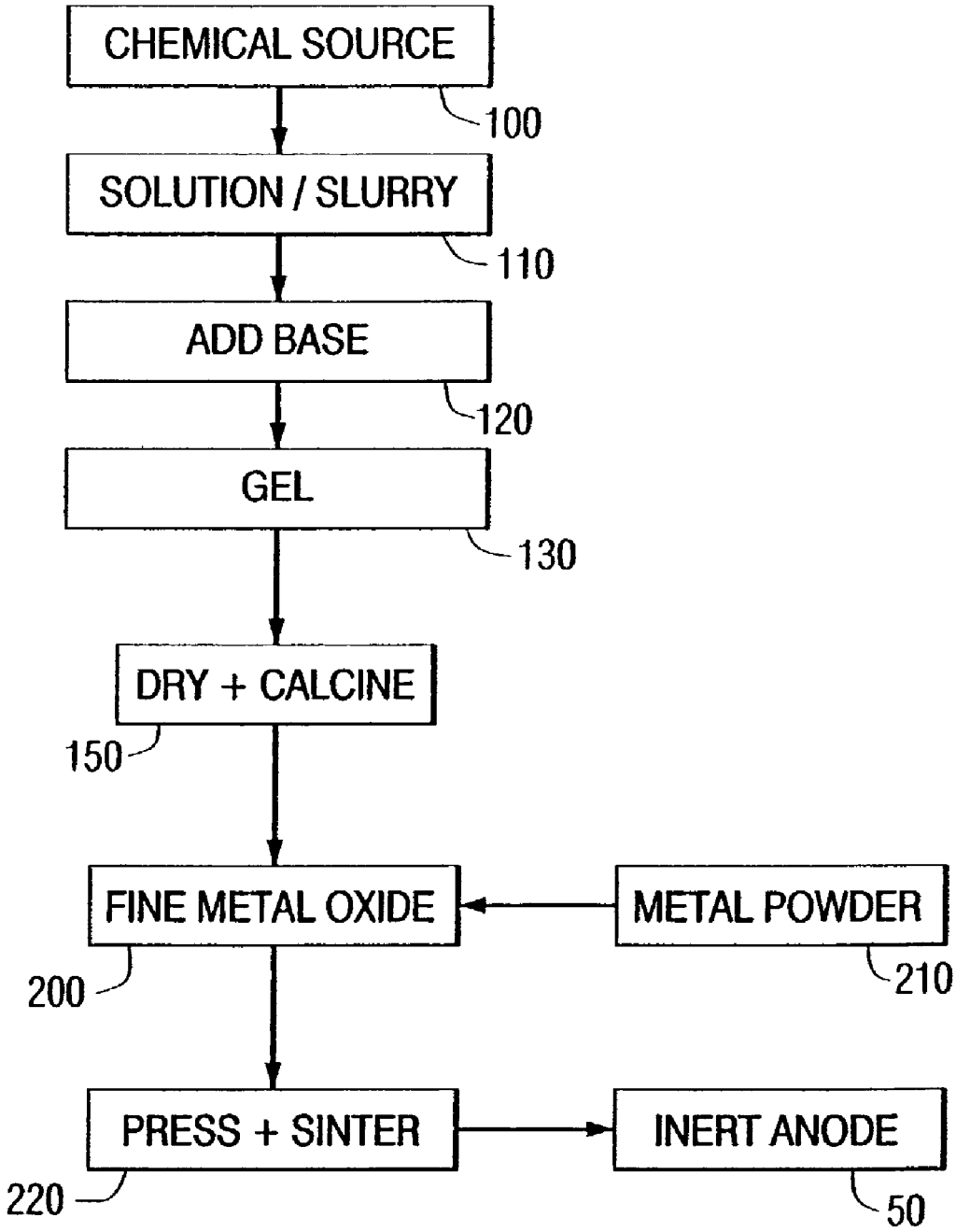
FIG. 4 is a block diagram showing a preferred method of this invention.
Figure 6:
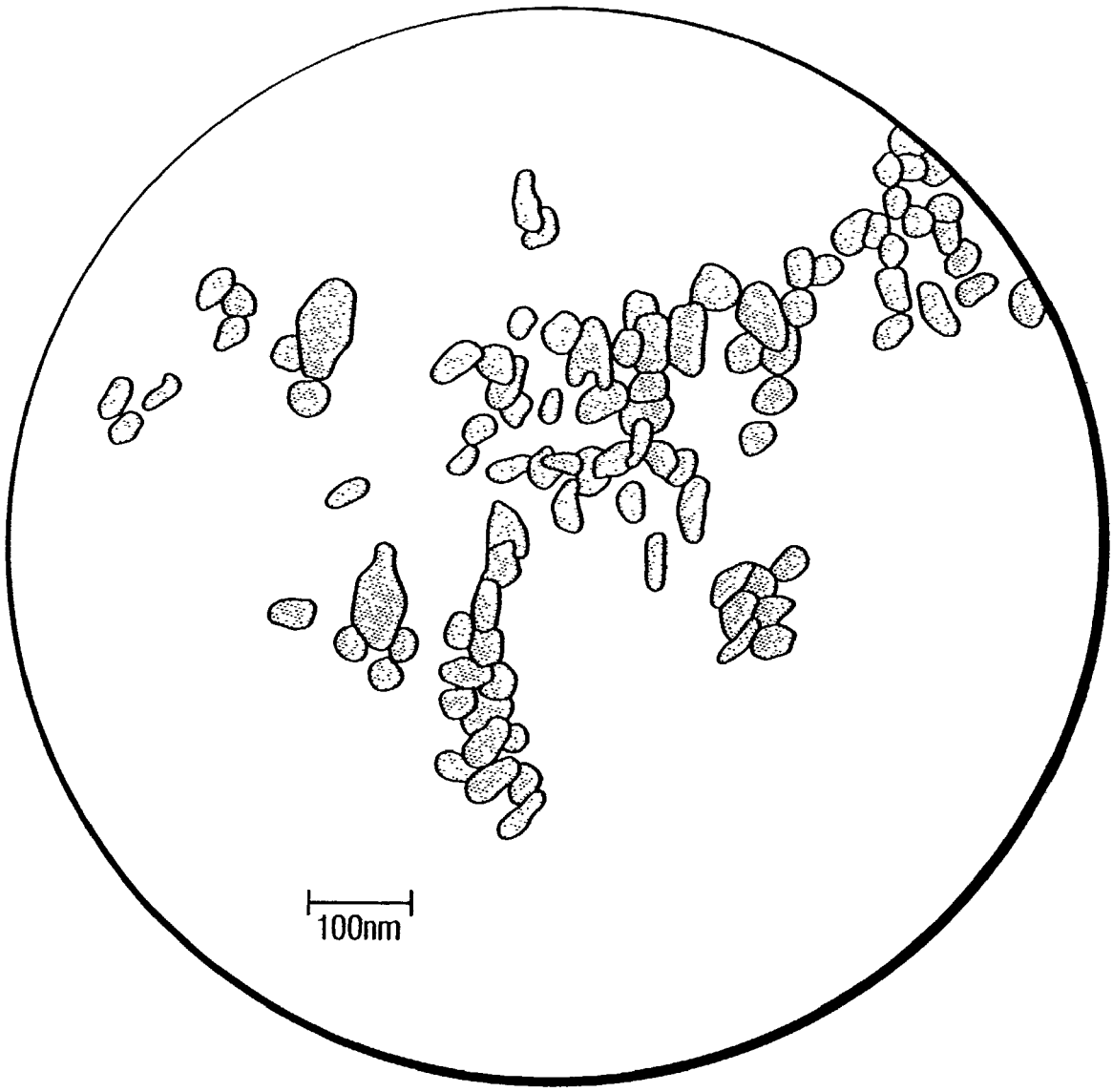
FIG. 6 is an idealized magnified drawing showing the relative diameters in nm of an 8 hr. ball milled, 600° C. calcined, Ni.Al.Fe oxide composition made by this invention.

The designed metal salts solution can be prepared by dissolving selected metals, metal oxides, metal salts or their mixture into the selected acid solution. Preferentially, in order to make sure all the metals are completely dissolved, a special procedure is developed. That is always adding the chemicals with least dissolution rate first to maximize the dissolution rate, and the one with fast dissolution rate is added last. For example, if the chemical sources are metal particles, the appropriate amount and concentration enough to dissolve all the metals of selected acid solutions is prepared first. The acid can be hydrochloric acid, acetate acid, nitric acid, tartarate acid, citrate acid and/or sulfuric acid. Add the metal with the slowest dissolution rate into the acid solution first, and add the method into the solution with the fastest dissolution rate last. If the chemical sources include metals and metal oxides, metals have to be dissolved in first as described above. Then metal oxides. If the chemical sources include metals, metal oxides, and metal salts, the sequence should be metals are added in first as described above, then metal oxides, and finally metal salts. In most cases, the solution is stirred and heated to speed up the dissolution rate as well as increase solubility. In step 120 various bases are added to the slurry to provide a partially co-precipitated gel 130. The gel containing solution can be dried and calcined in step 150 at the same time, or preferably dried in step 160 first. The dried gel 160 can then be calcined in step 190. Fine metal oxide powders 200 are provided which can optionally be ground to finer form of from about 5 nm to about 1000 nm. FIG. 6 is an idealized drawing showing the fine diameter powders of an 8 hr. ball milled 600° C. calcined Ni.Al.Fe oxide composition. This shows the advantages of this invention compared to prior art techniques exemplified by prior art methods shown in FIG. 1, where FIGS. 1 and 6 are the same scale. For a cermet inert anode the metal powder 210, of from about 1 micrometer to 100 micrometer average, can be added to the fine metal oxide powder. The combined powder can then be pressed and sintered in step 220 to provide inert anode 50. The preferred process is shown in FIG. 4, using the same numbers.

Concentrated metal ions solution preparation will now be described. The preparation of high concentrated metal ion solution will increase production and save time as well as energy during drying.

From salts: 1) Choosing salts with high solubility, and 2) dissolving the salts in water to form an aqueous solution, at a higher temperature in the range of about 23° C. to 100° C., will improve the dissolution rate and solubility.

Figure 5:
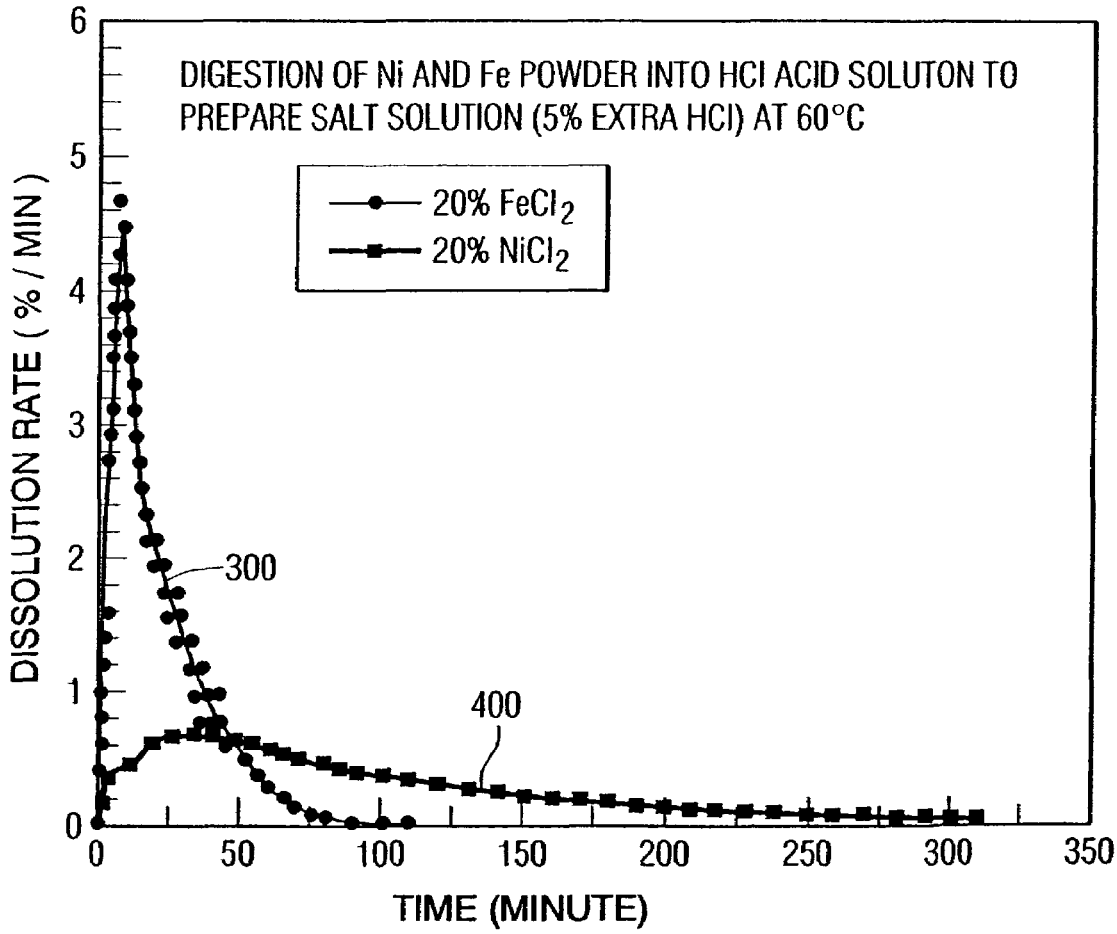
FIG. 5 shows the different digestion rates for Ni and Fe metal powders in HCl to prepare salt solutions at 60° C.

From metals: Because dissolving metals into the acid will generate hydrogen, apparatus with closed system are required to digest metals. This closed system can be composed of a sealed reactor with feeders on top. When metal powders are added, as in an aqueous slurry, off gas comes out through a trap which keeps residual chemicals in the gas flow and maintains pressure inside the reactor at 1 atmosphere. A special procedure has been developed for metal digestion. Various metals will require longer times for digestion, as shown in FIG. 5: digestion of Ni and Fe powder into an aqueous HCl acid solution to prepare salt solution (5% extra HCl) at 60° C.

From oxides: Same as digestion of metals, oxide particles need to be dissolved into an aqueous acid solution. Because no hydrogen will be generated, the process does not require a closed system. The same procedure for metal digestion will also be applied in oxide digestion.

From mixing of salts, metals, or oxides: According to the chemical precursors, metal ion solution can be prepared separately using above methods then mixing the solutions together. Or dissolving metal first, then oxides, and finally salts.

Gel-co-precipitation:

When dissolved in pure water, metal (M) salts are hydrolyzed by water molecules as:

$$M^{z+}+H_2O \rightarrow [M-OH_2]^{z+} \quad (1)$$

For transition metal cations, charge transfer from the water molecule to the transition metals can occur. This in turn causes the partial charge on the hydrogen to increase, making the water molecule more acidic. Depending on the magnitude of the charge transfer the following equilibrium is established, which is defined as hydrolysis.

$$[M(H_2O)_n]^{z+}=[M(H_2O)_{n-1}OH]^{(z-1)+}+H^+$$

The above hydrolysis can further condense and partially precipitate to:

$$2[M(H_2O)_n]^{z+}=[(H_2O)_{n-1}M(OH)_2M(H_2O)_{n-1}]^{(2z-2)+}+2H+$$

Obviously addition of ammonium or an organic base hydroxide will accelerate the above reaction. The valence of the metal ion and pH of the solution determine whether the metal ion has $H_2O$, OH— or $O^{2-}$ as their ligands. A gel-co-precipitate can be formed at appropriate pH range among those positively and negatively charged complexes by electrostatic forces for a given metal ions group. Because same metal ion complexes usually have same sign charges that will repel each other and they will likely attach to opposite charged other metal ion complexes. It will lead to a homogeneous gel-co-precipitate.

Washing/rinsing: because only ammonia/ammonium or organic base hydroxides are chosen, no washing/rinsing is necessary. It will prevent loss of some metal ions during washing/rinsing and preserve the initial designed composition.

Calcination: the gel-co-precipitates can be dried and then calcined in oxidized atmosphere at temperatures from 400° C. to 1200° C. Preferentially, the partially precipitate gel can be sprayed directly into oxidized atmosphere at temperatures from 400° C. to 1200° C. to produce oxide particles. A spray drier has a chamber that can either be heated from outside or from inside by passing hot air. The partially precipitated gel is sprayed into the hot chamber though an atomizer and is swirled around in the chamber by hot air circulating. The water evaporates and leaves dry and calcined powders.

Referring now in detail, a more specific description follows: Step 1 (100 in FIGS. 3 and 4), chemical precursors: First step is to select chemical precursors. Depending on cost and availability, the starting chemicals can be metal particles, metal salts, metal oxides or mixtures thereof. Metal particles and oxide particles and oxide powders have to be dissolved into acid to form salt solutions, which include one or a mixture of chlorides, acetates, nitrates, tartarates, citrates and/or sulfates of M=Ni, Fe, Cu, Co, Zn, Cr, Mn, Al, Sc, Y, La, Ti, Zr, Hf, V, Nb, Ta, Pd, Ag, Ca, Sr, or Sn, and the like. Chlorides, acetates and nitrates are preferred precursors.

Step 2 (110 in FIGS. 3 and 4), concentrated metal ion solution preparation:

From salts: 1) Choose salts with high solubility, for example, chlorides or nitrates of Ni and Fe have high solubility. 2) Dissolve the salts in de-ionized water, at a temperature from room temperature to 100° C. Higher temperature, stirring and rotation will improve the dissolution rate and solubility.

TABLE 4

Dissolution time of $Ni(NO_3)_{2.6}H_2O$ and $Fe(NO_3)_{3.9}H_2O$ at RT (about 23° C.) and 40° C.

| | Room Temperature Dissolution time (sec.) | 40° C. Dissolution time (sec) |
|---|---|---|
| 1. Ni(NO3)2.6H2O | | |
| $Ni(NO_3)_2$ Concentration | | |
| 20 | 36.41 | 12 |
| 30 | 58.17 | 23 |
| 40 | 83.51 | 46 |
| 50 | 113.11 | |
| 2. Fe(NO3)3.9H2O | | |
| Fe(NO3)3 concentration | | |
| 20 | 53 | 38.7 |
| 30 | 59 | 46 |
| 40 | 153 | 68 |
| 50 | 445 | 231 |

From metals: Because dissolving metals into the acid will generate hydrogen, apparatus with closed systems required to digest metals. A special procedure has been developed for metal digestion. Depending on the process, the appropriate amount and cocentration of selected acid solution is prepared first, the acid can be hydrochloric acid, acetate acid, nitric acid, tartarate acid, citrate acid and/or sulfuric acid. Add the metal with least dissolution rate into the acid solution first, and the last one added into the solution is the one with fastest dissolution rate. In order to improve the digestion rate, the acid solution can be heated up from room temperature up to 100° C. FIG. 5 shows the digestion rate of the metal into HCl to produce 20% $FeCl_2$ (circles—curve 300) and Ni metal into HCl to produce 20% $NiCl_2$ (square marks—curve 400) at 60° C. and shows that Fe and Ni metal have different digestion rates at the same conditions.

Step 3 (steps 120 and 130 in FIGS. 3 and 4), gel-co-precipitate formation: after metal salts, metal particles, metal oxides, or mixture of above are completely dissolved into the aqueous solution and form homogeneous concentrated solution, ammonium or an organic base hydroxide will be added to adjust solution pH to the range from 3 to 14 depending on the type of metal ions in the solution. As described above, dependent on solution pH and type of metal ions, hydrolysis and condensation of the metal ions will form different charged precipitates, which will attracted by electrostatic force and form homogeneous gel in the same time.

Step 4 (steps 150, 160 and 190 in FIGS. 3 and 4), dry/calcinations: the gel-co-precipitates can be dried and then calcined in oxidized atmosphere at temperatures from 400° C. to 1200° C. Preferentially, the partially precipitate gel can be sprayed directly into an oxidized atmosphere at temperatures from 400° C. to 1200° C. to produce oxide particles.

Step 5, optionally grinding/ball-mill: depending on calcination temperature, short time grinding/ball-milling may be applied to break up soft agglomeration. FIG. 9 showed the TEM picture of 600° C. calcines particle with composition Ni.Al.Fe oxide after 8 hr. ball-mill. FIG. 6 shows the TEM picture of 800° C. calcined particles with a composition of Ni.Al.Fe oxide after an 8 hr. ball-mill. Compared to FIG. 1, a more uniform size particle of about 5 nm to about 1000 nm, preferably 5 nm to about 500 nm, most preferably less than about 200 nm diameter powders are produced by the gel-co-precipitation technique compared to conventional solid state reaction methods.

Step 6 (steps 210 and 200 in FIGS. 3 and 4), spray-dry: adding the metal oxide powder and binder. Preferably a well known dispersant will be added in a amount and manner effective to provide a homogeneous slurry. Then, optionally, a metal powder can also be added if a cermet is desired. This can provide a slurry of oxides and/or metal oxide or metaloxide/metal powders, to provide a metal oxide/metal composition containing up to 50 wt. % metal powder. The metal powder can be any of the metals previously mentioned as useful in forming the precursor. The slurry is then spray dried to form granules.

Step 7 (steps 220 of FIGS. 3 and 4), anode fabrication: pressing the spray-dried granules to form a green body at about 2000 psi to about 50,000 psi. Firing the formed green body in oxygen partial pressure controlled atmospheres at temperatures from 1100° C. up to 1650° C. Or alternately, hot pressing the as-synthesized powders or spray-dried powders in oxygen partial pressure controlled atmospheres at temperatures from 1100° C. up to 1650° C.

While the invention has been described in terms of preferred embodiment, various changes, additions and modifications may be made without departing from the steps of the invention. Having described the presently preferred embodiments, it is to be understood that the invention may be otherwise embodied within the scope of the appended claims.

What is claimed is:

1. A method of producing an inert anode for an electrolytic cell where the anode is made from multi-element metal oxide powders containing at least three elements, comprising the steps:

(a) providing a precursor aqueous solution comprising metal ions;

(b) adjusting the pH of the precursor aqueous solution with a basic solution to the pH range of from 3–14 such that a gel is formed;

(c) calcining the gel to provide metal oxide powder;

(d) adding the metal oxide powder and a material comprising a binder to a solvent to form a slurry;

(e) spray drying the slurry to form granules; and (f) pressing the granules.

2. The method of claim 1, where step (f) provides a green body which is then fired to produce an inert anode and the material added in step (d) also contains a dispersant and metal powder.

3. The method of claim 1, wherein the metal ions are selected from the group consisting of Ni, Fe, Cu, Co, Zn, Mn, Al, Se, Y, La, Ti, Zr, Hf, V, Nb, Ta, Pd, Ag, Cr, Sr, and Sn, and after step (c), the blend of metal oxide powders is comminuted.

4. The method of claim 1, where the inert anode is a ceramic.

5. The method of claim 2, where the inert anode is a cermet.

6. A method of producing an inert anode for an electrolytic metal cell where the anode is made from multi-element metal oxide powders containing at least three elements, comprising the steps:

(a) providing a precursor aqueous solution by dissolving at least one material selected from the group consisting of metal salts, metal particles, metal oxides, and mixtures thereof, where the precursor aqueous solution contains metal ions;

(b) adjusting the pH of the precursor aqueous solution with a base solution in the pH range of from 3–14 such that a gel is formed;

(c) calcining the gel to provide metal oxide powder;

(d) adding the metal oxide powder and a binder to a solvent to form a slurry;

(e) spray drying the slurry to form granules;

(f) pressing the granules to form a green body; and (g) firing the green body.

7. The method of claim 6, wherein the aqueous precursor solution is a solution of metals salts, where the salts are selected from the group consisting of chlorides, acetates, nitrates, tartarates, citrates, sulfates, and mixtures thereof, and the gel formed in step (b) is dried before step (c).

8. The method of claim 6, wherein the metal ions are selected from the group consisting of Ni, Fe, Cu, Co, Zn, Cr, Mn, Al, Se, Y, La, Ti, Zr, Hf, V, Nb, Ta, Pd, Ag, Cr, Sr, and Sn, and after step (c), the blend of metal oxide powders is comminuted, and in step (d) at least one of a dispersant and metal powder is also added.

9. The method of claim 6, wherein the inert anode is a ceramic.

10. The method of claim 8, wherein the inert anode is a cermet.

11. An inert anode made by the process of claim 6.

12. A method of producing an inert anode for an electrolytic metal cell where the anode is made from fine, homogeneous multicomponent metal oxide powders containing at least three elements, comprising the steps:

(a) providing a homogeneous precursor aqueous solution by dissolving at least one material selected from the group consisting of metal salts, metal particles, metal oxides, and mixtures thereof, where the precursor aqueous solution contains metal ions selected from the group consisting of Ni, Fe, Cu, Co, Zn, Cr, Mn, Al, Sc, Y, La, Ti, Zr, Hf, V, Nb, Ta, Pd, Ag, Cr, Sr, or Sn and mixtures thereof;

(b) adjusting the pH of the precursor aqueous solution with a base solution selected from at least one of ammonium hydroxide solution and organic base hydroxide solution, to the pH range of from 3 to 14 such that a gel is formed;

(c) optionally drying the gel;

(d) calcining the gel at from about 400° C. to 1200° C. to provide metal oxide powder;

(e) optionally grinding the metal oxide powder;

(f) adding the metal oxide powder and a material selected from at least one of dispersant and binder to a solvent to provide a slurry;

(g) spray drying the slurry to form granules; and (h) pressing the granules and firing to form an inert anode.

13. The method of claim 12, where pressing in step (h) forms a green body which is then fired to form the anode.

14. The method of claim 12, wherein the precursor aqueous solution is a metal salt dissolved in water, and in step (f) a metal powder is also added.

15. The method of claim 12, wherein the precursor aqueous solution is metal particles dissolved in an aqueous acid solution in a closed system.

16. The method of claim 12, wherein the precursor aqueous solution is metal oxides dissolved in an aqueous acid solution.

17. The method of claim 12, wherein the powder blend produced by calcining in step (d) has a particle size range of about 5 nm to about 1000 nm.

18. The method of claim 12, wherein firing is carried out at temperatures from about 1100° C. to 1500° C.

19. The method of claim 12, wherein the inert anode is a ceramic.

20. The method of claim 14, wherein the inert anode is a cermet.

21. A method of producing an inert anode for an electrolytic metal cell where the anode is made from fine, homogeneous multicomponent metal oxide powders comprising the steps:

(a) providing a precursor by dissolving at least one material selected from the group consisting of metal salts, metal particles, metal oxides and mixtures thereof where the precursor aqueous solution contains at least two metal ions;

(b) adjusting the pH of the precursor aqueous solution with a base solution selected from at least one of ammonium hydroxide solution and organic base hydroxide solution, to the pH range of from 3 to 12 such that a co-precipitated gel is formed;

(c) spraying the co-precipitated gel into an oxidizing atmosphere at a temperature of from 400° C. to 1,200° C. to provide a blend of metal oxide powders having a homogeneous dispersion of the metal ions in the powder particles, said powders having a particle size of from about 5 nm to about 1000 nm;

(d) adding the powder and a material selected from at least one of dispersant and binder to a solvent to provide a slurry;

(e) spray-drying the slurry to form granules; and (f) pressing the granules to form a green body;

(g) firing the green body to produce an inert anode.

22. The method of claim 21, wherein the powders formed in step (c) have a particle size range of from about 10 nm to about 100 nm, and in step (d) a metal powder is added.

23. The method of claim 21, wherein the inert anode is a ceramic.

24. The method of claim 22, wherein the inert anode is a cermet.

25. An inert anode made by the method of claim 21.

* * * * *